US011572665B2

(12) United States Patent
Sondreal

(10) Patent No.: US 11,572,665 B2
(45) Date of Patent: Feb. 7, 2023

(54) MILLING SYSTEMS AND METHODS FOR A MILLING MACHINE

(71) Applicant: Caterpillar Paving Products Inc., Brooklyn Park, MN (US)

(72) Inventor: Dustin W. Sondreal, Hanover, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 17/186,255

(22) Filed: Feb. 26, 2021

(65) Prior Publication Data

US 2022/0274290 A1 Sep. 1, 2022

(51) Int. Cl.

| | |
|---|---|
| ***E01C 23/088*** | (2006.01) |
| ***B28D 1/18*** | (2006.01) |
| ***E01C 23/12*** | (2006.01) |
| ***E21C 35/19*** | (2006.01) |
| *E21C 35/183* | (2006.01) |

(52) U.S. Cl.

CPC ..... *E01C 23/088* (2013.01); *B28D 1/188* (2013.01); *E01C 23/127* (2013.01); *E21C 35/19* (2013.01); *E21C 35/1833* (2020.05); *E21C 35/1837* (2020.05)

(58) Field of Classification Search

CPC ..... E21C 35/1831; E21C 35/1833; E21C 35/191; E21C 35/183; E21C 35/1835; E21C 35/1837; E21C 35/18; E21C 35/19; E21C 35/193; E21C 35/1933; E21C 35/1936; E21C 35/197; E01C 23/088; E01C 23/127; B28D 1/188

See application file for complete search history.

(56) References Cited

U.S. PATENT DOCUMENTS 3,834,764 A * 9/1974 Krekeler ..... E21C 35/18 299/108
5,582,468 A * 12/1996 Latham ..... E21C 35/18 299/106
5,884,979 A 3/1999 Latham (Continued)

FOREIGN PATENT DOCUMENTS

DE 3644601 A1 * 7/1988 ..... B28D 1/188
EP 3563038 B1 11/2019

OTHER PUBLICATIONS

English language machine translation of Wirtgen, German Patent Publication No. DE-3644601-A, published Jul. 28, 1988 (4 pages) (Year: 1988).*

*Primary Examiner* — Abby J Flynn
*Assistant Examiner* — Michael A Goodwin
(74) *Attorney, Agent, or Firm* — Bookoff McAndrews, PLLC

(57) ABSTRACT

A milling system for a milling machine includes at least one cutting assembly configured to be coupled to a drum. Each of the cutting assemblies includes a base portion and an impact portion. The base portion includes a standoff coupled to the drum, a first base block coupled to the standoff, and a second base block coupled to the standoff at a position upstream of the first base block in a direction of rotation of the drum and at angle from the first base block. The impact portion includes a cutting bit and a tool holder coupled to the first base block, and a protective element coupled to the second base block.

20 Claims, 5 Drawing Sheets

(56) References Cited

U.S. PATENT DOCUMENTS

| | | | | |
|---|---|---|---|---|
| 6,213,560 | B1 * | 4/2001 | Lindblom | B28D 1/186 299/39.4 |
| 8,870,297 | B2 | 10/2014 | Pederson et al. | |
| 10,640,934 | B2 | 5/2020 | Magee et al. | |
| 2013/0119746 | A1 * | 5/2013 | Clark | E21C 35/18 299/79.1 |
| 2013/0334866 | A1 * | 12/2013 | Pederson | B28D 1/188 299/39.4 |
| 2016/0024920 | A1 * | 1/2016 | Hall | E21C 25/10 299/39.8 |
| 2017/0275992 | A1 * | 9/2017 | Persano | E21C 35/19 |
| 2017/0335686 | A1 * | 11/2017 | Seibert | E21C 35/19 |
| 2018/0171568 | A1 * | 6/2018 | Laclef | E01C 23/127 |
| 2018/0328174 | A1 * | 11/2018 | Magee | E21C 25/10 |
| 2018/0371711 | A1 * | 12/2018 | Crocker | E01C 23/0993 |
| 2019/0143562 | A1 * | 5/2019 | Magee | B28D 1/186 299/39.8 |
| 2022/0030755 | A1 * | 2/2022 | Meier | A01B 33/12 |

* cited by examiner

MILLING SYSTEMS AND METHODS FOR A MILLING MACHINE

TECHNICAL FIELD

The present disclosure relates generally to a milling machine, and more particularly, to milling systems and methods for a milling machine.

BACKGROUND

The present invention relates to milling machines that are used to repair and/or reclaim a road surface. Milling machines are typically utilized to break up one or more layers of an old or defective road or other surface. Machines, such as cold planers, rotary mixers, and other milling machines, are used for scarifying, removing, mixing, or reclaiming material from ground surfaces, such as, grounds, roadbeds, and the like. Such machines include a rotor enclosed within a rotor chamber. The rotor includes a cylindrical shell member, or drum, and a number of cutting assemblies mounted on the shell member. When the machine is performing a cutting operation, cutting bits of the cutting assemblies impact the surface and break the surface apart. Thus, the cutting assemblies are arranged to cut the surface and to leave a milled surface, and different cutting assemblies often leave milled surfaces with different finishes, for example, textures, mixtures (e.g., with an emulsion fluid, water, etc.), densities, roughnesses, etc. One or more portions of the cutting assemblies or the drum may be adjusted and/or replaced in order to modify the resulting milled surface. Furthermore, one or more portions of the cutting assemblies may break, wear down, or otherwise require maintenance or replacement, leading to machine downtime.

U.S. Pat. No. 5,884,979, issued to Latham on Mar. 23, 1996 ("the '979 patent"), describes a cutting assembly that includes a cylindrical driven member with a surface that includes a plurality of recesses in a preselected pattern, with each recess including a bottom surface depressed below the surface of the cylindrical driven member. The '979 patent also includes a plurality of cutting bit holding elements. Each cutting bit holding element includes an aperture to receive a cutting bit and a lower portion sized to be received within one of the recesses in the cylindrical driven member. Each cutting bit holding element includes a locating element, and each recess includes a niche, such that the locating elements and the niches can be aligned to help ensure proper alignment of the cutting bit holding elements within the recesses. However, the cutting assembly of the '979 patent may not provide sufficient support, adjustment, or protection of the cutting elements on the cutting assembly, and servicing the cutting assembly of the '979 patent may require special tools. The systems and methods of the present disclosure may solve one or more of the problems set forth above and/or other problems in the art. The scope of the current disclosure, however, is defined by the attached claims, and not by the ability to solve any specific problem.

SUMMARY

In one aspect, a milling system for a milling machine may include at least one cutting assembly configured to be coupled to a drum. Each of the cutting assemblies may include a base portion and an impact portion. The base portion may include a standoff coupled to the drum, a first base block coupled to the standoff, and a second base block coupled to the standoff at a position upstream of the first base block in a direction of rotation of the drum and at angle from the first base block. The impact portion may include a cutting bit and a tool holder coupled to the first base block, and a protective element coupled to the second base block.

In another aspect, a method of adjusting milling properties of a rotor for a milling machine may include accessing the rotor. The rotor may include a drum and a plurality of cutting assemblies. Each cutting assembly may include a standoff coupled to the drum, a first base block coupled to the standoff, a second base block coupled to the standoff at a position upstream of the standoff in a direction of rotation of the rotor, a cutting bit, a tool holder coupled to the first base block and holding the cutting bit, and a first protective element coupled to the second base block. The method may include removing the first protective element and coupling a second protective element to the second base block. The rotor with the second protective element may have a different milling property than the rotor with the first protective element. The method also may include enclosing the rotor.

In yet another aspect, a cutting assembly for a milling machine may include a base portion and an impact portion. The base portion may include a standoff coupled to a drum, a first base block coupled to the standoff, and a second base block identical to the first base block coupled to the standoff at a position upstream of the first base block in a direction of rotation of the rotor and at an angle relative to the first base block. The impact portion may include a cutting bit and a tool holder coupled to the first base block, and a protective element coupled to the second base block.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

For the purpose of this disclosure, the term "ground surface" is broadly used to refer to all types of surfaces that form typical roadways (e.g., asphalt, cement, clay, sand, gravel, dirt, etc.) or can be milled in the removal or formation of roadways. In this disclosure, relative terms, such as, for example, "about," "substantially," and "approximately," are used to indicate a possible variation of ±10% in a stated value. Although the current disclosure is described with reference to a milling machine, such as, for example, a cold planer (or road miller), or a rotary mixer (or reclaimer or soil stabilizer), this is only exemplary, and the features described herein may be used on any relevant machine.

Figure 1:
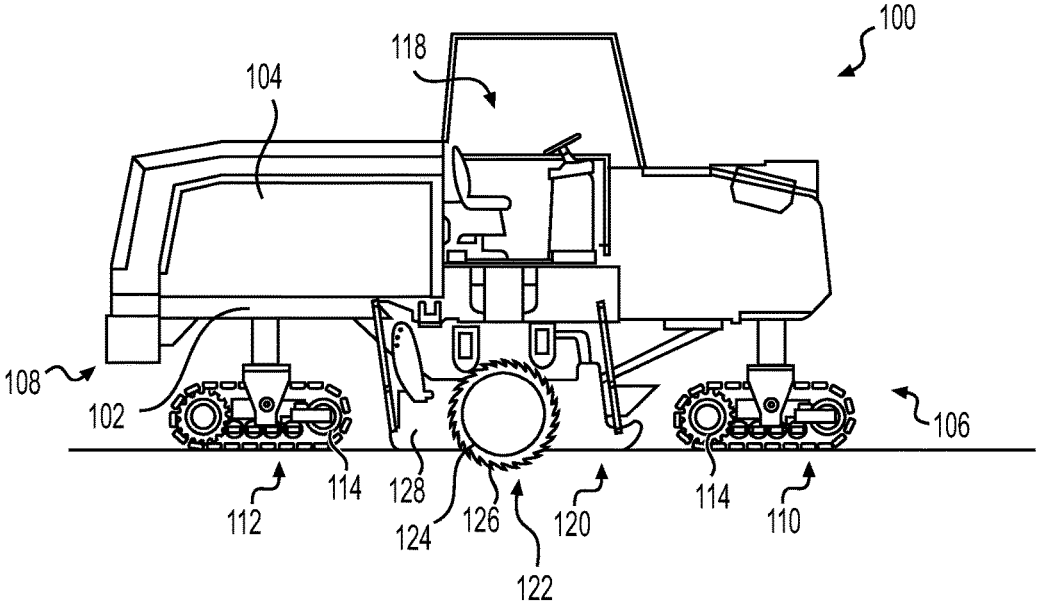
FIG. 1 is a side schematic view of an exemplary machine.

FIG. 1 is a side schematic view of an exemplary machine 100, according to one embodiment of the present disclosure. As shown, machine 100 may be a road reclaimer. Nevertheless, as mentioned above, this disclosure is not so limited, and machine 100 may be another machine that removes or recycles material from a ground surface. Machine 100 includes a rotor chamber 120 that encloses a rotor 122. Rotor 122 includes generally cylindrical shell member or drum 124 with a number of cutting assemblies 126 that engage with and help remove material from the ground surface. Cutting assemblies 126 may be arranged circumferentially on drum 124 in any pattern or arrangement, for example, forming a chevron pattern.

Machine 100 has a frame 102. An engine enclosure 104 may be attached to frame 102 and may house an engine (not shown). The engine may be an internal combustion engine and may provide propulsion power to machine 100 and power various components of machine 100. Machine 100 has a front end 106 and a rear end 108. Front end 106 of machine 100 may have a front drive assembly 110, and rear end 108 may have a rear drive assembly 112. Each of front and rear drive assemblies 110, 112 may include a pair of tracks 114. Tracks 114 may be driven by a hydraulic system of machine 100. Alternatively, machine 100 may include wheels (not shown). Machine 100 may have an operator platform 118. When machine 100 is embodied as a manual or semi-autonomous machine, an operator of machine 100 may sit or stand at operator platform 118 to operate machine 100.

As mentioned, machine 100 includes rotor chamber 120, which may be positioned between front and rear drive assemblies 110, 112. Rotor chamber 120 is an enclosed or partially enclosed space defined by a first side plate 128 and a second side plate (not shown) disposed on respective sides of machine 100. Although not shown, rotor chamber 120 may also be defined by a front door and a rear door, or a moldboard, for example, to help enclose rotor 122, to controllably direct material from the ground surface, and/or to help form a smooth milled surface. Rotor chamber 120 may be movable relative to frame 102 in order to adjust a position of rotor chamber 120 relative to the ground surface. Alternatively, rotor chamber 120 may be fixed relative to frame 102, and frame 102 may be movable relative to the ground surface. Rotor 122 is rotatably coupled to frame 102 and is positioned within rotor chamber 120. In at least one aspect, rotor 122 is movable (e.g., height adjustable) relative to rotor chamber 120 and/or frame 102.

Figure 2A:
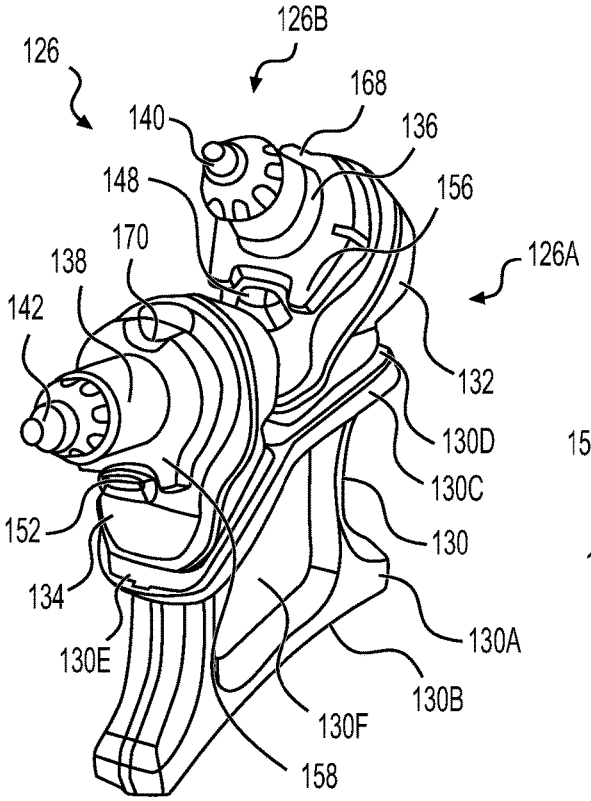
FIG. 2A is a perspective view of a cutting assembly in a first configuration.
Figure 2B:
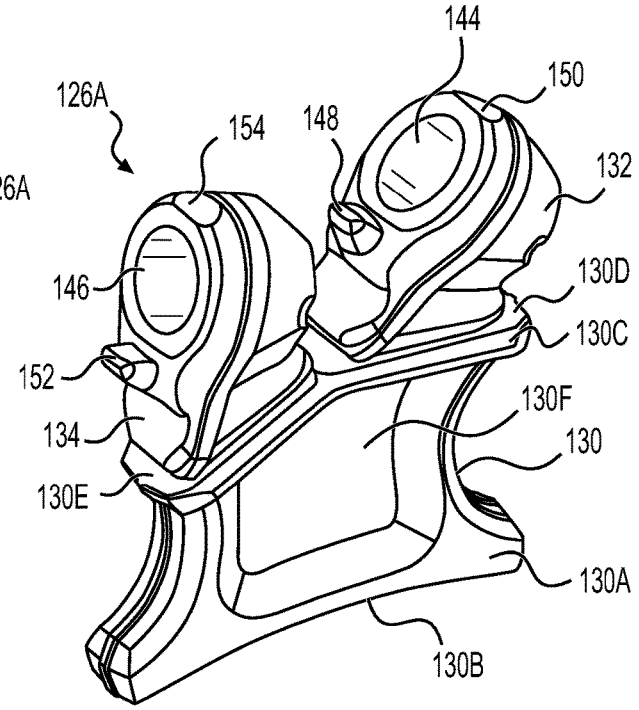
FIG. 2B is a perspective view of a portion of the cutting assembly.

FIG. 2A illustrates a perspective view of cutting assembly 126, and FIG. 2B is a perspective view of a portion of cutting assembly 126. FIG. 2A shows cutting assembly 126 having a double-hit protection configuration.

As shown in FIG. 2A, each cutting assembly 126 includes a bottom or support portion 126A and a primary or impact portion 126B. As discussed herein, impact portion 126B may be removably coupled to support portion 126A. Additionally, one or more different impact portions 126B (or configurations of impact portion 126B) may be coupled to support portion 126A, for example, to adjust the aggressiveness of the cut performed by rotor 122, the smoothness and/or gradation of the resulting ground surface, the protection of one or more components of each cutting assembly 126, etc.

As shown in FIGS. 2A and 2B, support portion 126A includes a drum block or standoff 130, a primary or first base block 132, and an auxiliary or second base block 134. Additionally, impact portion 126B includes a primary or first tool holder 136 and an auxiliary or second tool holder 138. A first impact element, for example, a first cutting bit 140 may be at least partially positioned within and coupled to first tool holder 136. A second impact element, for example, a protective element or a second cutting bit 142 maybe at least partially positioned within and coupled to second tool holder 138. As discussed below, different impact elements may be coupled to second tool holder 138 compared to first tool holder 136 in order to modify the performance of rotor 122 and the output of machine 100. In at least one aspect, first tool holder 136 and second tool holder 138 may be identical. Furthermore, in at least one aspect, first cutting bit 140 and second cutting bit 142 may be identical. Additionally, when first tool holder 136 is coupled to first base block 132 and second tool holder 138 is coupled to second base blocks 132 and 134, first tool holder 136 and second tool holder 138 may be at least partially aligned, for example, in the direction of rotation of cutting assembly 126 when coupled to drum 124. Similarly, when first cutting bit 140 is coupled to first tool holder 136 and second cutting bit 142 coupled to second tool holder 138, first cutting bit 140 and second cutting bit 142 may be at least partially aligned, for example, in the direction of rotation of cutting assembly 126 when coupled to drum 124.

Standoff 130 may be formed of a metallic material (e.g., stainless steel), and may be welded or otherwise fixedly coupled to drum 124 (FIG. 1). First tool block or base block 132 and second tool block or base block 134 may be formed of a metallic material (e.g., stainless steel), and may be welded or otherwise fixedly coupled to standoff 130. Additionally, as shown in FIG. 2B, first base block 132 includes a first receptacle 144, and second base block 134 includes a second receptacle 146. First and second receptacles 144 and 146 may each receive tool holders (e.g., first tool holder 136 and second tool holder 138) or other coupling portions in order to couple cutting bits, flat paddles, tapered paddles, etc. to standoff 130. For example, first cutting bit 140 may be fixedly coupled within an opening in first tool holder 136, and second cutting bit 142 may fixedly coupled within an opening in second tool holder 138. Moreover, portions of tool holders 136 and 138 may be press-fit into first and second receptacles 144 and 146. As rotor 122 rotates, the cutting bit, flat paddle, tapered paddle, or other protective element coupled to second base block 134 may be ahead or forward of the cutting bit or other element coupled to first base block 132. In this aspect, second base block 134 and the element coupled to second base block 134 may help to break up, mix, direct, or otherwise treat the ground surface, and also protect first base block 132 and the element (e.g., a cutting bit and a tool holder) coupled to first base block 132. For example, as material from the ground surface moves over the rotor 122, second base block 134 is rotationally upstream of first base block 132.

Standoff 130 includes a base portion 130A. Base portion 130A may include a curved bottom surface 130B, for example, at least partially corresponding to contours of an outer surface of drum 124. Standoff 130 also includes a support portion 130C configured to be coupled to one or more of first base block 132 and second base block 134. For example, support portion 130C may include a first coupling surface 130D and a second coupling surface 130E. First coupling surface 130D and second coupling surface 130E may be substantially flat or planar. When cutting assembly 126 is positioned at the top or bottom of rotor 122, first coupling surface 130D may be parallel to the ground surface and/or parallel to a longitudinal axis of machine 100. Second coupling surface 130E may be angled relative to first coupling surface 130D. For example, second coupling surface 130E may be oriented at an angle of approximately 10 degrees to approximately 75 degrees, approximately 20 degrees to approximately 50 degrees, approximately 30 degrees, etc. from first coupling surface 130D.

Standoff 130 may also include a central portion 130F extending between base portion 130A and support portion 130C. In one aspect, central portion 130F may include a tapered and/or reduced thickness over one or more portions between base portion 130A and support portion 130C. Standoff 130 may be formed by a forging process. In another aspect, standoff 130 may be formed by a casting process, for example, by pouring a molten metal into a mold such that the metal cools and solidifies into the shape of the mold. In yet another aspect, standoff 130 may be formed of plate steel. Although not shown, in some aspects, standoff 130 or other portions of cutting assembly 126 may include a pitch or other contours that may help to form an auger that helps to move material within rotor chamber 120 toward a central area of rotor chamber 120, for example, where the material can be mixed with another material (e.g., a binder material) or mixed with additional removed material.

As shown in FIG. 2B, first base block 132 includes first receptacle 144, and second base block 134 includes second receptacle 146. First receptacle 144 may be a generally cylindrical opening in first base block 132, and second receptacle 146 may be a generally cylindrical opening in second base block 134. Moreover, first base block 132 may include an extension 148 and an indention 150. Extension 148 may be positioned between first receptacle 144 and first base block 132, and indention 150 may be positioned on an opposite side of first receptacle 144 from extension 148. Similarly, second base block 134 may include an extension 152 and an indentation 154. Extension 152 may be positioned between second receptacle 146 and second base block 134, and indentation 154 may be positioned on an opposite side of second receptacle 146 from extension 152. Extension 148 and indentation 150 may help orient first tool holder 136 relative to first base block 132, and extension 152 and indentation 154 may help orient second tool holder 138 relative to second base block 134. Extensions 148 and 152 and indentations 150 and 154 may help to provide access to cutting bits 140 and 142 for inspection, adjustment, maintenance, replacement, etc. As discussed in detail below, first tool holder 136 may include a forked portion 156 that at least partially overlaps with extension 148 of first base block 132, and second tool holder 138 may include a forked portion 158 that at least partially overlaps with extension 152 of second base block 134. The overlap may help limit rotational movement between first tool holder 136 and first base block 132 and between second tool holder 138 and second base block 134.

As shown, first base block 132 and second base block 134 may be identical or similar shapes, sizes, etc. Alternatively, first base block 132 and second base block 134 may be different shapes, sizes, etc., for example, depending on the size and/or shape of standoff 130, the size and/or shape of first tool holder 136 and second tool holder 138, etc. First base block 132 and second base block 134 may be formed via a forging, casting, molding, or other appropriate formation process.

Figure 3A:
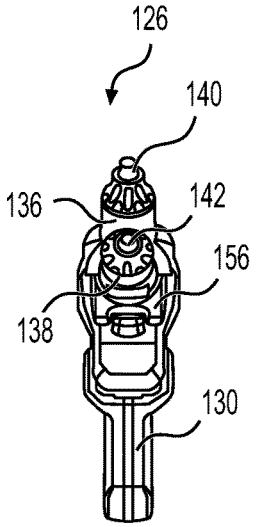
FIGS. 3A and 3B are various views of the cutting assembly in the first configuration.
Figure 3B:
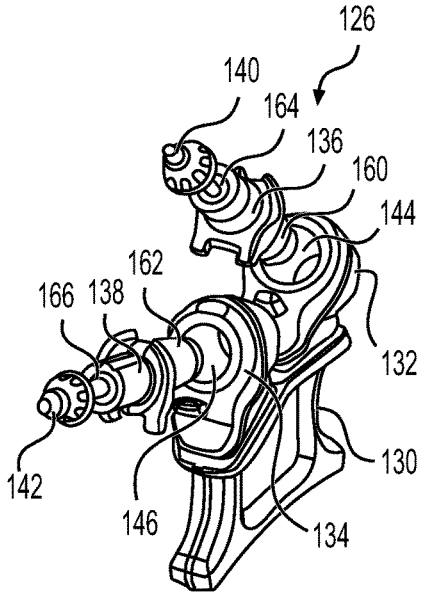

FIGS. 3A and 3B illustrate different views of cutting assembly 126 in the double-hit protection configuration shown in FIG. 2A. As mentioned, FIG. 2A is a perspective of cutting assembly 126. FIG. 3A is a front (or cutting side) view of cutting assembly 126, and FIG. 3B is a partially exploded view of cutting assembly 126. Specifically, FIG. 3B shows first tool holder 136 partially removed from first base block 132, and first cutting bit 140 partially removed from first tool holder 136. FIG. 3B also shows second tool holder 138 partially removed from second base block 134, and second cutting bit 142 partially removed from second tool holder 138. As discussed above, first base block 132 and second base block 134 are coupled to standoff 130.

As shown in FIG. 3B, tool holders 136 and 138 may include coupling portions 160 and 162, for example, to be received within first receptacle 144 and second receptacle 146. Moreover, tool holders 136 and 138 may each include holder portions 164 and 166, for example, to receive portions of first cutting bit 140 and second cutting bit 142. Furthermore, as shown in FIGS. 2A, 3A, and 3B, tool holders 136 and 138 may include forked portions 156 and 158 and grooves 168 and 170. Forked portions 156 and 158 may at least partially align with extensions 148 and 152. As discussed below, one or more of a wedge and sledgehammer may be used to help uncouple first tool holder 136 from first base block 132 and uncouple second tool holder 138 from second base block 134. Tool holders 136 and 138 may be formed via a forging, molding, or other appropriate formation process.

Cutting bits 140 and 142 may be formed of a hard material configured to cut into the ground surface, for example, formed of a carbide-based or diamond-based material, and may be press-fit, brazed, or otherwise fixedly coupled to the tool holders 136 and 138. As mentioned, one or more other cutting or protection elements (e.g., a flat paddle, a tapered paddle, additional cutting bits, etc.) may be coupled to second base block 134, and these other cutting or protection elements may be formed via a forging process, a casting process, etc., and may be press-fit, brazed, or otherwise fixedly coupled to second tool holder 138. As such, cutting bits 140 and 142 may contact the ground surface to engage and remove material. For example, rotor 122 can be lowered and rotated so that rotor 122 contacts and cuts the ground surface through force applied by cutting assemblies 126 (e.g., via cutting bits 140 and 142) on the ground surface. Nevertheless, first cutting bit 140 extends beyond second cutting bit 142, and thus first cutting bit 140 defines the depth of the cut into the ground surface. Additionally, second base block 134, second tool holder 138, and second cutting bit 142 may help to cut, mix, or deflect material on or removed from the ground surface, while also helping to protect first base block 132, first tool holder 136, and first cutting bit 140. For example, as shown in FIG. 3A, second base block 134, second tool holder 138, and second cutting bit 142 at least partially block first base block 132, first tool holder 136, and first cutting bit 140 in the cutting direction.

Figure 4A:
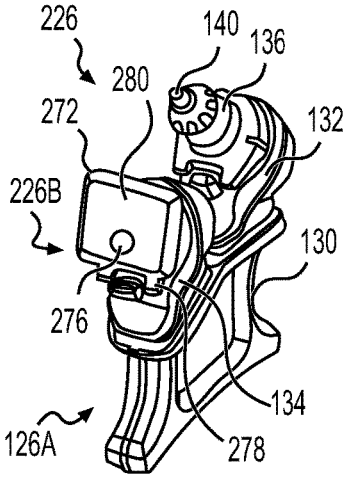
FIGS. 4A-4C are various views of one cutting assembly in a second configuration.
Figure 4B:
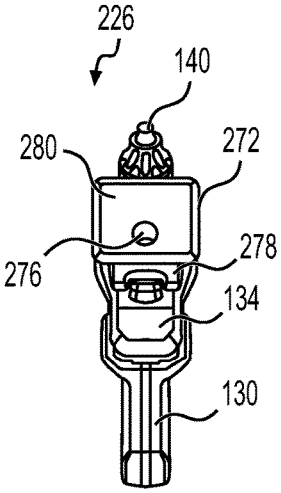
Figure 4C:
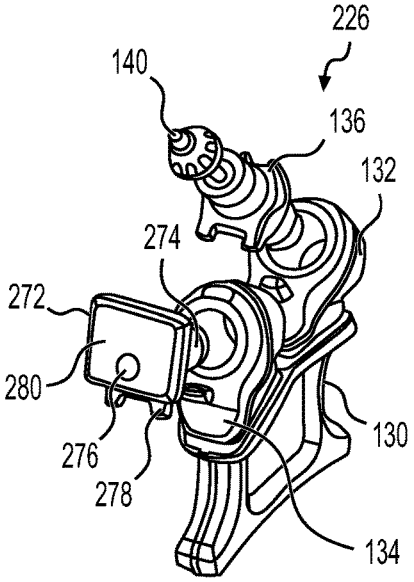

FIGS. 4A-4C illustrate different views of another cutting assembly 226. Cutting assembly 226 is similar to cutting assembly 126, and includes base portion 126A and an impact portion 226B. Impact portion 226B includes first tool holder 136 and first cutting bit 140, and includes a flat paddle 272 and coupling portion 274. In this aspect, FIGS. 4A-4C illustrate cutting assembly 226 having a flat paddle protection configuration. Coupling portion 274 may be identical to or similar to coupling portion 160 of tool holder 138, for example, for flat paddle 272 to be removably coupled to second base block 134, which is coupled to standoff 130. FIG. 4A is a perspective view of cutting assembly 226, and FIG. 4B is a front (or cutting side) view of cutting assembly 226. FIG. 4C is a partially exploded view of cutting assembly 226. Specifically, FIG. 4C shows first tool holder 136 partially removed from first base block 132, and first cutting bit 140 partially removed from first tool holder 136. FIG. 4C also shows flat paddle 272 and coupling portion 274 partially removed from second base block 134.

Flat paddle 272 may be formed of a metallic material (e.g., a steel, such as chromium steel, via a forging or casting process). Flat paddle 272 may also include an opening 276, which may receive a tool to help remove flat paddle 272 from second base block 134. The tool (e.g., a hydraulic puller, wedge, acme screw apparatus, etc.) may be positioned in front of flat paddle 272. Additionally, flat paddle 272 may include a forked portion 278, similar to forked portion 158. Flat paddle 272 includes a flat front face 280, which may help to cut, mix, or deflect material on or removed from the ground surface, while also helping to protect first base block 132, first tool holder 136, and first cutting bit 140. For example, as shown in FIG. 4B, flat paddle 272 at least partially blocks first base block 132, first tool holder 136, and first cutting bit 140 in the cutting direction. Nevertheless, first cutting bit 140 extends beyond flat paddle 272, and thus first cutting bit 140 defines the depth of the cut into the ground surface. Furthermore, it is noted that, in a first aspect, in order to transition from cutting assembly 126 to cutting assembly 226, second cutting bit 142 and second tool holder 138 may be removed from second base block 134, and flat paddle 272 may be coupled to second base block 134.

Figure 5A:
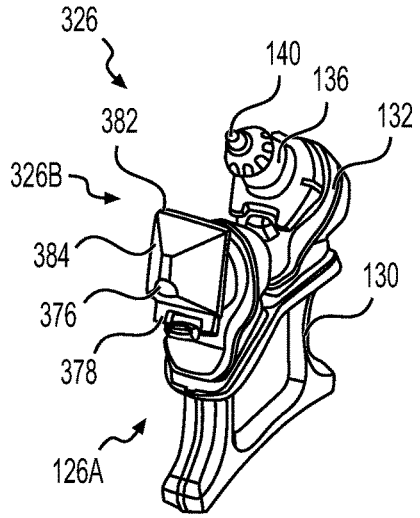
FIGS. 5A-5C are various views of one cutting assembly in a third configuration.
Figure 5B:
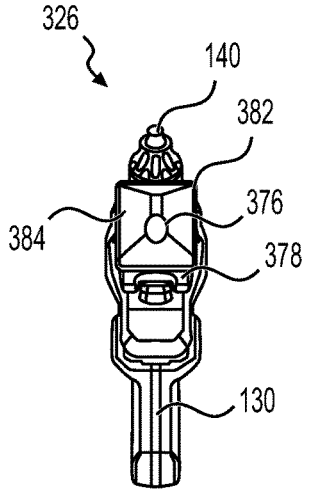
Figure 5C:
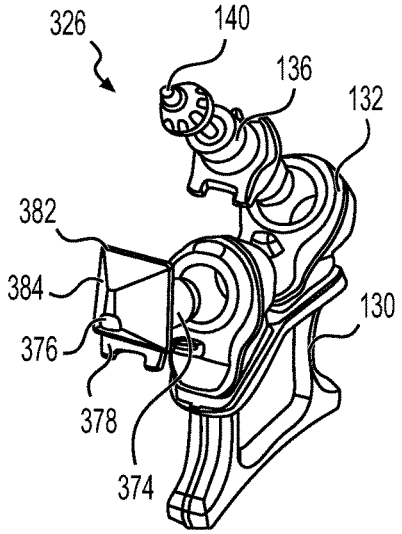

FIGS. 5A-5C illustrate different views of another cutting assembly 326. Cutting assembly 326 is similar to cutting assembly 126, and includes base portion 126A and an impact portion 326B. Impact portion 326B includes first tool holder 136 and first cutting bit 140, and includes a tapered paddle 382 with a coupling portion 374, similar to coupling portion 274. In this aspect, FIGS. 5A-5C illustrate cutting assembly 326 having a tapered paddle protection configuration. Coupling portion 374 may be identical to or similar to coupling portion 160 of tool holder 138, for example, for tapered paddle 382 to be removably coupled to second base block 134, which is coupled to standoff 130. FIG. 5A is a perspective of cutting assembly 326, and FIG. 5B is a front (or cutting side) view of cutting assembly 326. FIG. 5C is a partially exploded view of cutting assembly 326. Specifically, FIG. 5C shows first tool holder 136 partially removed from first base block 132, and first cutting bit 140 partially removed from first tool holder 136. FIG. 5C also shows coupling portion 374 of tapered paddle 382 partially removed from second base block 134.

Tapered paddle 382 may be formed of a metallic material (e.g., a steel, such as chromium steel, via a forging or casting process). Tapered paddle 382 may also include an opening 376, which may receive a tool to help remove tapered paddle 382 from second base block 134. The tool (e.g., a hydraulic puller, wedge, acme screw apparatus, etc.) may be positioned in front of tapered paddle 382. Additionally, tapered paddle 382 may include a forked portion 378, similar to forked portion 158. Tapered paddle 382 includes a tapered or angled front face 384, which may help to cut, mix, or deflect material on or removed from the ground surface, while also helping to protect first base block 132, first tool holder 136, and first cutting bit 140. For example, as shown in FIG. 5B, tapered paddle 382 at least partially blocks first base block 132, first tool holder 136, and first cutting bit 140 in the cutting direction. Milling with tapered paddle 382 may result in different mixing and/or gradation than milling with flat paddle 272 or other protective elements discussed herein. Nevertheless, first cutting bit 140 extends beyond tapered paddle 382, and thus first cutting bit 140 defines the depth of the cut into the ground surface. Furthermore, it is noted that, in order to transition from cutting assembly 126 to cutting assembly 326, second cutting bit 142 and second tool holder 138 may be removed from second base block 134, and tapered paddle 382 may be coupled to second base block 134 via coupling portion 374.

Figure 6A:
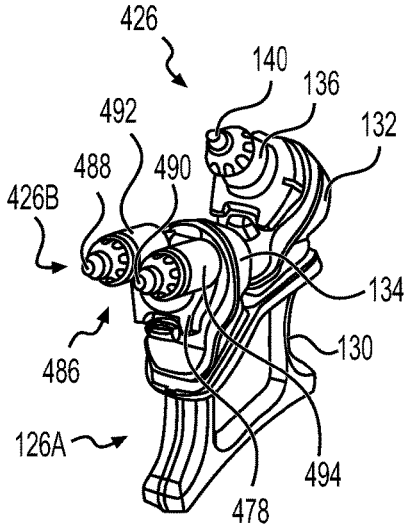
FIGS. 6A-6C are various views of one cutting assembly in a fourth configuration.
Figure 6B:
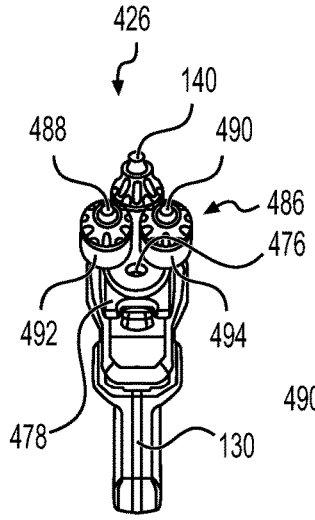
Figure 6C:
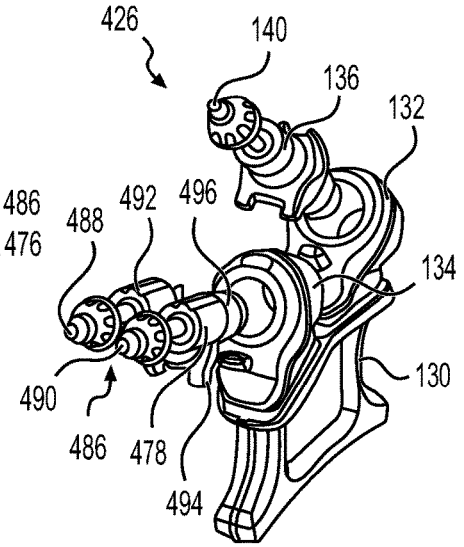

FIGS. 6A-6C illustrate different views of another cutting assembly 426. Cutting assembly 426 is similar to cutting assembly 126, and includes base portion 126A and an impact portion 426B. Impact portion 426B includes first tool holder 136 and first cutting bit 140, and includes a dual-tip assembly 486. Dual-tip assembly 486 includes a first auxiliary cutting bit 488 and a second auxiliary cutting bit 490. Dual-tip assembly 486 also includes a first auxiliary tool holder 492 and a second auxiliary tool holder 494. First auxiliary cutting bit 488 may be coupled to first auxiliary tool holder 492, and second auxiliary cutting bit 490 may be coupled to second auxiliary tool holder 492. Furthermore, dual-tip assembly 486 also includes a coupling portion 496 (FIG. 6C), which may be similar to coupling portions 274 and 374 and may help couple dual-tip assembly 486 to second base block 134. First auxiliary tool holder 492, second auxiliary tool holder 494, and coupling portion 496 may be integrally formed, or may be separate elements that are coupled in the formation of dual-tip assembly 486. First auxiliary cutting bit 488 and second auxiliary cutting bit 490 may be similar or identical to the cutting bits discussed above, for example, first cutting bit 140 and second cutting bit 142. Dual-tip assembly 486 may also include an opening 476, a forked portion 478, and an indentation (not shown) similar to the openings, forked portions, and indentations discussed above.

In this aspect, FIGS. 6A-6C illustrate cutting assembly 426 having a triple-hit (or triceratops) protection configuration. FIG. 6A is a perspective of cutting assembly 426, and FIG. 6B is a front (or cutting side) view of cutting assembly 426. FIG. 6C is a partially exploded view of cutting assembly 426. Specifically, FIG. 6C shows first tool holder 136 partially removed from first base block 132, and first cutting bit 140 partially removed from first tool holder 136. FIG. 6C also shows dual-tip assembly 486 partially removed from second base block 134, and first and second auxiliary cutting bits 488 and 490 partially removed from dual-tip assembly 486.

Figure 7:
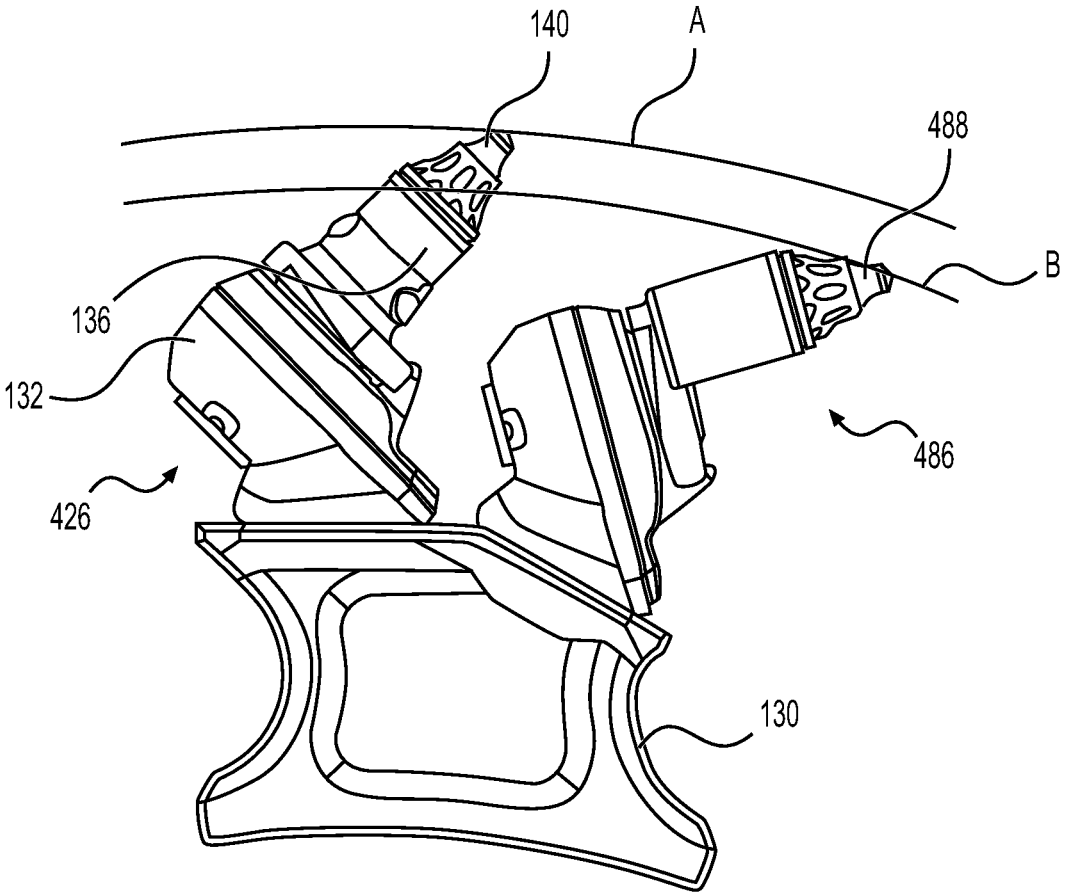
FIG. 7 illustrates cutting paths of the cutting assembly of FIGS. 6A-6C.

Accordingly, cutting assembly 426 includes three cutting bits 140, 488, 490, for example, arranged in a triangular arrangement. Furthermore, cutting bits 488 and/or 490 may include a different arrangement (e.g., a pitch) relative to the cutting direction than each other and/or than cutting bit 140, for example, to make narrower or wider, less aggressive or more aggressive, etc. cuts into the ground surface. Additionally, as shown in FIG. 6B, dual-tip assembly 486 at least partially blocks first base block 132, first tool holder 136, and first cutting bit 140 in the cutting direction. Nevertheless, as shown in FIG. 7, first cutting bit 140 extends beyond dual-tip assembly 486, and thus first cutting bit 140 defines the depth of the cut into the ground surface. As discussed above, in order to transition from cutting assembly 126 to cutting assembly 426, second cutting bit 142 and second tool holder 138 may be removed from second base block 134, and dual-tip assembly 486 may be coupled to second base block 134.

FIG. 7 shows a side view of cutting assembly 426. As shown, first cutting bit 140 has a cutting path A as cutting assembly 426 is rotated by drum 124. Additionally, dual-tip assembly 486 includes first and second auxiliary cutting bits 488 and 490, with cutting bit 488 shown in FIG. 7. Cutting bit 488 and cutting bit 490 (not shown) form cutting path B. Cutting bits 488 and 490 may help to cut, mix, or deflect material on or removed from the ground surface, while also helping to protect first base block 132, first tool holder 136, and first cutting bit 140. For example, first auxiliary cutting bit 488 and second auxiliary cutting bit 490 may extend the same distance from standoff 130, and thus the same distance from drum 124, to form path B. Additionally, first base block 132 and a majority of first tool holder 136 are radially interior, or closer to standoff 130 and drum 124 (not shown), than cutting path B, so auxiliary cutting bits 488 and 490 may help to protect first base block 132 and first tool holder 136 from impacts, wear, etc. Nevertheless, cutting path A of first cutting bit 140 extends radially outward of, or beyond, cutting path B, and thus contacts the ground surface as cutting assembly 426 is rotated to determine the depth of the cut into the ground surface. The size of dual-tip assembly 486 and the angle between first and second coupling surfaces 130D and 130E (FIGS. 2A and 2B) may affect the difference between cutting path A and cutting path B, for example, the distance that first cutting bit 140 extends beyond dual-tip assembly 486 as cutting assembly 426 is rotated. In these aspects, first base block 132, first tool holder 136, and first cutting bit 140 may have a longer lifespan, required less maintenance, etc.

Similarly, second cutting bit 142, flat paddle 272, or tapered paddle 382 may also help to protect the other components of the respective cutting assemblies and form respective cutting (or protection) paths similar to cutting path B shown in FIG. 7. Although not shown, the other configurations (i.e., FIGS. 2A, 3A, 3B, 4A-4C, and 5A-5C) also help to protect first base block 132, first tool holder 136, and first cutting bit 140 in a similar manner. For example, the protective elements may extend radially outward of, or beyond, the entireties or portions of first base block 132 and first tool holder 136, which may help to reduce the force and/or likelihood of impacts from the ground surface or material removed from the ground surface on first base block 132 and first tool holder 136. The reduced force and/or likelihood of impacts may help to improve the durability and/or lifetime of first base block 132 and/or first tool holder 136, and may also help to reduce the likelihood of one or more couplings (e.g., the coupling of first tool holder 136 to first base block 132) requiring repair. Additionally, the size of the different protective elements (e.g., second cutting bit 142, flat paddle 272, or tapered paddle 382), and the angle between first and second coupling surfaces 130D and 130E (FIGS. 2A and 2B) may affect the distance that first cutting bit 140 extends beyond the protective element as the cutting assembly is rotated. Nevertheless, in these aspects, first cutting bit 140 extends beyond the protective elements and determines the depth of the cut into the ground surface.

Figure 8:
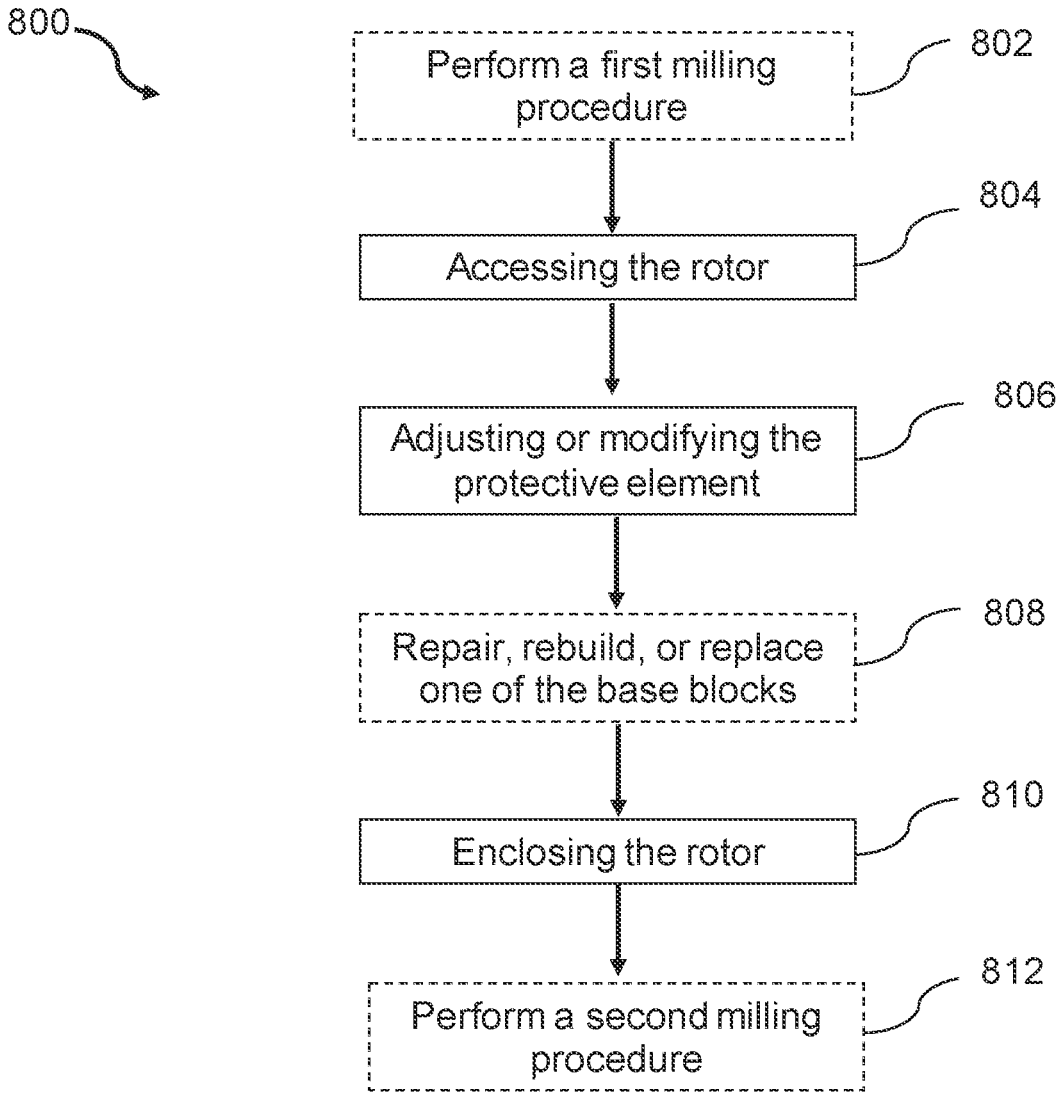
FIG. 8 provides a flow chart depicting an exemplary method for adjusting the configuration of one or more cutting assemblies.

FIG. 8 is a flow chart of a method 800 that may be performed to adjust or modify a protective element coupled to second base block 134, and thus to adjust the milling performance of machine 100.

Method 800 may include an optional initial step 802 of performing a first procedure, for example, with second cutting bit 142 and second tool holder 138 coupled to second base block 134, as discussed above, to form a double-hit configurations. Second cutting bit 142 and second tool holder 138 may help to contact, mix, and break up the ground surface, while also helping to protect first base block 132, first tool holder 136, and first cutting bit 140. Next, method 800 includes a step 804, which includes accessing rotor 122. Step 804 may include ending a milling procedure and/or placing machine 100 in an adjustment mode (e.g., engaging a parking brake). In one example, accessing rotor 122 may include opening a side plate (e.g., first side plate 128), a rear moldboard or door (not shown), or a front door (not shown). Alternatively or additionally, a portion of rotor 122 (e.g., drum 124) may be removed from rotor chamber 120.

Method 800 may further include a step 806 of adjusting or modifying the protective element coupled to second base block 134. In this aspect, step 806 includes removing second cutting bit 142 and second tool holder 138 from second base block 134. In some aspects, removing second cutting bit 142 and second tool holder 138 from second base block 134 may include using a wedge and a sledgehammer. For example, the wedge may be positioned between second tool holder 138 and second base block 134, and hitting the wedge with the sledgehammer may help to uncouple second tool holder 138 from second base block 134. Similarly, if another protective element is coupled to second base block 134, the wedge may be positioned between the protective element and second base block 134.

Step 806 also includes coupling another protective element to second base block 134. For example, flat paddle 272 may be coupled to second base block 134. As discussed above, coupling portion 274 may be fixedly coupled (e.g., via a press-fit) into second receptacle 146 in second base block 134. Step 806 may be performed for each cutting assembly 126 on drum 124 of rotor 122, for example, to convert each cutting assembly 126 in a double-hit configuration to cutting assemblies 226 with a flat paddle protection configuration. Step 806 may be performed as many times as necessary, for example, to alternatively couple tapered paddle 382, dual-tip assembly 486, or another protective element to second base block 134. Moreover, although not specifically discussed, one or more cutting bits may be removed from respective tool holders, for example, with a pick and a hammer. One or more cutting bits may be replaced when worn down, may be preventatively replaced after a period of use, or may be otherwise adjusted to modify the cutting features (e.g., size, pitch, width, etc.) of each cutting bit of each cutting assembly.

Method 800 may include an optional step 808 that includes repairing, rebuilding, or replacing one of the base blocks (e.g., first base block 132 or second base block 134). For example, if one of the base blocks is damaged, worn down, etc., the base block may be repaired or rebuilt, for example, by repairing the connection (i.e., weld) between the base block and standoff 130. Alternatively, the connection between the base block and standoff 130 may be broken, and a new base block may be coupled to standoff 130 (e.g., via welding).

Method 800 also includes a step 810 that includes enclosing rotor 122. For example, step 808 may include closing a side plate (e.g., first side plate 128), the rear moldboard or door (not shown), or the front door of rotor chamber 120. Alternatively or additionally, a portion of rotor 122 (e.g., drum 124) may be inserted into rotor chamber 120.

Lastly, method 800 may include another optional step 812 that includes performing a second milling procedure, or second portion of the first milling procedure. As discussed above, the second milling procedure may have different milling characteristics from the first milling procedure, with the different protective element coupled to drum 124.

Method 800 may be performed for some or all of cutting assemblies 126 as many times as necessary to adjust the protective element on the cutting assemblies in order to perform the desired milling procedures, for example, to yield a desired finish on the ground surface. For example, a first portion of the milling procedure may be performed with a first protective element to yield a first finish on the ground surface, and a second portion of the milling procedure may be performed with a second protective element to yield a second finish on the ground surface. Furthermore, a third portion of the milling procedure may be performed with a third protective element or the first protective element, for example, to yield either a third finish or the first finish on the ground surface.

INDUSTRIAL APPLICABILITY

The disclosed aspects of machine 100 may be used in any milling machine to assist in removal of the milled material, while allowing for variations in the performance of cutting assemblies 126. For example, the disclosed aspects of machine 100 may allow for the milled surface left by machine 100 to be adjusted without replacing drum 124 or other portions of rotor 122.

For example, the double-hit configuration (i.e., FIGS. 2A, 3A, and 3B) may allow for second cutting bit 142 of each cutting assembly 126 to assist first cutting bit 140 in cutting, mixing, or breaking up the ground surface, which may allow for machine 100 to traverse the ground surface more quickly. Specifically, second cutting bit 142 may help reduce the risk of over-running or over-working first cutting bits 140, as there are more cutting bits coupled to rotor 122 and each cutting bit is doing less work on the ground surface. Additionally, the flat paddle configuration (i.e., FIGS. 4A-4C) may allow for flat paddle 272 to contact, mix, or break-up the ground surface and/or material removed from the ground surface such that the resulting ground surface includes a smoother gradation, for example, due to flat front face 280 of flat paddle 272. In another aspect, the tapered paddle configuration (i.e., FIGS. 5A-5C) may allow for rotor 122 to move (e.g., mix or break up) material more effectively or efficiently, with less resistance caused by removed material from the ground surface as rotor 122 rotates, for example, due to angled front face 384 of tapered paddle 382. Furthermore, the dual-tip configuration (i.e., FIGS. 6A-6C and 7) may allow for rotor 122 to perform even more aggressive cutting, mixing, or breaking up of the ground surface, as each cutting assembly 426 includes three cutting bits. The dual-tip configuration may also reduce likelihood of abrasion on first base block 132, first tool holder 136, or first cutting bit 140, for example, when the ground surface includes gravel or sand. Furthermore, each of the configurations may help to protect first base block 132, first tool holder 136, and first cutting bit 140, as discussed above, for example, by reducing the wear and/or risk of damage or breakage to each component, increasing the usable lifetime of each component, as well as drum 124.

As mentioned above, the configurations of the protective elements may be adjusted, for example, via method 800. The replacement of the protective elements may be performed with a wedge and a sledgehammer, tools that are commonly on machine 100, rather than requiring a blow torch, an impact, wrenches, bolts, etc. The replacement of the protective elements may be performed by one or two operators, and the replacement of the protective elements on drum 124 may be performed in a few hours. Accordingly, configurations discussed herein may be replaced easily and/or with limited machine downtime.

Method 800 may allow an operator to quickly adjust the milling properties of machine 100, for example, by replacing a protective element or a cutting bit and a tool holder. In this manner, the milling properties of rotor 122 may be adjusted quickly without removing drum 124. For example, the user may access rotor 122, for example, by opening a side plate (e.g., first side plate 128 or the second side plate), a rear moldboard or door, or a front door. The user may then remove a first protective element from second base block 134 and couple a second protective element to second base block 134 to adjust the milling properties of rotor 122, as discussed above. The user may repeat this replacement for each cutting assembly 126 on drum 124, and then enclose rotor 122 and perform another milling procedure. Accordingly, the resulting roughness, or finish, of the ground surface may be adjusted by replacing the protective elements, without replacing drum 124.

Furthermore, if one of the base blocks is damaged, worn down, etc., the base block may be repaired or rebuilt, for example, by repairing the connection (i.e., weld) between the base block and standoff 130. Alternatively, the connection between the base block and standoff 130 may be broken, and a new base block may be coupled to standoff 130 (e.g., via welding). Accordingly, the base blocks may be rebuilt or replaced without removing standoff 130 from drum 124, which may help to reduce machine downtime.

It will be apparent to those skilled in the art that various modifications and variations can be made to the disclosed machine without departing from the scope of the disclosure. Other embodiments of the machine will be apparent to those skilled in the art from consideration of the specification and practice of the milling system and related methods disclosed herein. It is intended that the specification and examples be considered as exemplary only, with a true scope of the disclosure being indicated by the following claims and their equivalents.

What is claimed is:

1. A milling system for a milling machine, comprising:

at least one cutting assembly configured to be coupled to a drum, wherein each of the at least one cutting assembly includes:

a base portion, including a standoff configured to be welded to a radial exterior of the drum and extending radially away from the radial exterior of the drum, a first base block coupled to the standoff, and a second base block coupled to the standoff at a position upstream of the first base block in a direction of rotation of the drum and oriented at an angle from the first base block; and an impact portion, including a cutting bit and a tool holder coupled to the first base block, and a protective element coupled to the second base block, wherein the first base block and the second base block are similar in structure such that the first base block includes a first receptacle and a first extension adjacent to the first receptacle, and the second base block includes a second receptacle and a second extension adjacent to the second receptacle, wherein the standoff includes a base portion coupled to the drum and a support portion with a first coupling surface supporting the first base block and a second coupling surface supporting the second base block, wherein the second coupling surface is angled by approximately 30 degrees relative to the first coupling surface, and wherein the standoff further includes a central portion extending between the base portion and the support portion, wherein the central portion includes a tapered and/or reduced thickness over one or more portions between the base portion and the support portion.

2. The milling system of claim 1, wherein the first base block is welded to the first coupling surface, wherein the second base block is welded to the second coupling surface, and wherein the first base block and the second base block are identical.

3. The milling system of claim 1, wherein the cutting bit is a first cutting bit, and the tool holder is a first tool holder, wherein the protective element includes a second tool holder and a second cutting bit, wherein the second tool holder is identical to the first tool holder, wherein the second cutting bit is identical to the first cutting bit, and wherein the first cutting bit extends beyond the second cutting bit as the at least one cutting assembly is rotated.

4. The milling system of claim 3, wherein the first cutting bit and the second cutting bit are aligned as the at least one cutting assembly is rotated.

5. The milling system of claim 1, wherein the protective element includes a flat paddle or a tapered paddle, wherein the flat paddle or the tapered paddle include a coupling portion configured to be removably coupled within a receptacle in the second base block, and wherein the cutting bit extends beyond the flat paddle or the tapered paddle as the at least one cutting assembly is rotated.

6. The milling system of claim 1, wherein the protective element includes a dual-tip assembly with first and second auxiliary cutting bits, first and second tool holders, and a coupling portion configured to be removably coupled within a receptacle in the second base block, and wherein the cutting bit extends beyond of the first and second auxiliary cutting bits as the at least one cutting assembly is rotated.

7. The milling system of claim 1, wherein the tool holder is removably positioned within the first receptacle and includes a first forked portion that partially surrounds the first extension, and wherein the protective element is removably positioned within the second receptacle and includes a second forked portion that partially surrounds the second extension.

8. The milling system of claim 1, wherein the standoff is formed of a stainless steel.

9. The milling system of claim 8, wherein the standoff is formed by a forging process.

10. The milling system of claim 8, wherein the standoff is formed by a casting process.

11. The milling system of claim 8, wherein the standoff is formed of plate steel.

12. A method of adjusting milling properties of a rotor for a milling machine, comprising:

accessing the rotor, wherein the rotor includes a drum and a plurality of cutting assemblies, wherein each cutting assembly includes a standoff coupled to a radial exterior of the drum, a first base block coupled to the standoff, a second base block coupled to the standoff at a position upstream of the standoff in a direction of rotation of the rotor, a cutting bit, a tool holder coupled to the first base block and holding the cutting bit, and a first protective element coupled to the second base block, wherein the second base block is identical to the first base block and is oriented at an angle of approximately 30 degrees from the first base block;

removing the first protective element and coupling a second protective element to the second base block, wherein the rotor with the second protective element has a different milling property than the rotor with the first protective element, wherein the second protective element has a different shape than the first protective element; and enclosing the rotor, wherein the second base block includes an extension, wherein the first and second protective elements include a forked portion that partially surrounds the extension when the protective element is coupled to the second base block.

13. The method of claim 12, wherein the cutting bit is a first cutting bit and the tool holder is a first tool holder, wherein the second protective element includes a second cutting bit and a second tool holder, and wherein the first cutting bit extends beyond the second cutting bit as the drum is rotated.

14. The method of claim 12, wherein the second protective element includes a flat paddle or a tapered paddle, and wherein the cutting bit extends beyond the flat paddle or the tapered paddle as the drum is rotated.

15. The method of claim 12, wherein the second protective element includes two auxiliary cutting bits and two auxiliary tool holders, and wherein the cutting bit extends beyond the two auxiliary cutting bits as the drum is rotated.

16. The method of claim 12, further comprising: uncoupling one of the base blocks from the standoff and welding a new base block to the standoff without uncoupling the standoff from the drum.

17. A cutting assembly for a milling machine, comprising:

a base portion, including a standoff coupled to a radial exterior of a drum, a first base block coupled to the standoff, and a second base block identical to the first base block coupled to the standoff at a position upstream of the first base block in a direction of rotation of the drum and at an angle relative to the first base block; and an impact portion, including a cutting bit and a tool holder coupled to the first base block, and a protective element coupled to the second base block, wherein the standoff includes a base portion and a support portion, wherein the base portion is configured to be coupled to the drum, and wherein the support portion includes a first coupling surface supporting the first base block and a second coupling surface supporting the second base block, wherein the second coupling surface is angled by approximately 30 degrees relative to the first coupling surface, and wherein the standoff further includes a central portion extending between the base portion and the support portion, wherein the central portion includes a tapered and/or reduced thickness over one or more portions between the base portion and the support portion.

18. The cutting assembly of claim 17, wherein the cutting bit is a first cutting bit and the tool holder is a first tool holder, wherein the protective element includes a second cutting bit and a second tool holder, and wherein the first cutting bit extends beyond the second cutting bit as the cutting assembly is rotated.

19. The cutting assembly of claim 17, wherein the protective element includes a flat paddle or a tapered paddle, and wherein the cutting bit extends beyond the flat paddle or the tapered paddle as the cutting assembly is rotated.

20. The cutting assembly of claim 17, wherein the protective element includes a dual-tip assembly with first and second auxiliary cutting bits and first and second auxiliary tool holders, and wherein the cutting bit extends beyond the first and second auxiliary cutting bits as the cutting assembly is rotated.

* * * * *